US011345373B2

(12) United States Patent
Morin

(10) Patent No.: US 11,345,373 B2
(45) Date of Patent: May 31, 2022

(54) STABILIZING TRANSOM

(71) Applicant: Standard Car Truck Company, Rosemont, IL (US)

(72) Inventor: Andrew J. Morin, Mokena, IL (US)

(73) Assignee: Standard Car Truck Company, Rosemont, IL (US)

( * ) Notice: Subject to any disclaimer, the term of this patent is extended or adjusted under 35 U.S.C. 154(b) by 414 days.

(21) Appl. No.: 16/673,369

(22) Filed: Nov. 4, 2019

(65) Prior Publication Data

US 2020/0189626 A1 Jun. 18, 2020

Related U.S. Application Data

(60) Provisional application No. 62/781,379, filed on Dec. 18, 2018.

(51) Int. Cl.
*B61F 5/52* (2006.01)
*B61F 3/02* (2006.01)

(52) U.S. Cl.
CPC . *B61F 5/52* (2013.01); *B61F 3/02* (2013.01)

(58) Field of Classification Search
CPC ..... B61F 5/52; B61F 3/02
See application file for complete search history.

(56) References Cited

U.S. PATENT DOCUMENTS

| | | | | |
|---|---|---|---|---|
| 4,633,786 | A * | 1/1987 | Pavlick | B61F 5/52 105/203 |
| 8,474,383 | B1 * | 7/2013 | Berg | B61F 3/02 105/208 |
| 10,029,712 | B2 * | 7/2018 | Wike | B61F 5/52 |
| 2017/0158209 | A1 * | 6/2017 | Wike | B61F 5/04 |
| 2020/0189626 | A1 * | 6/2020 | Morin | B61F 5/04 |
| 2021/0139056 | A1 * | 5/2021 | Morin | B61F 5/38 |

* cited by examiner

*Primary Examiner* — Jason C Smith
(74) *Attorney, Agent, or Firm* — McCoy Russell LLP

(57) ABSTRACT

Various embodiments provide a stabilizing transom. Various embodiments provide a vehicle truck such as a railroad car truck including a first side frame, a second side frame, a bolster, and a stabilizing transom connected to the first side frame and the second side frame and configured to reduce, inhibit, minimize, and/or prevent truck hunting and warping.

25 Claims, 11 Drawing Sheets

DETAIL A
SCALE 1 : 1

STABILIZING TRANSOM

PRIORITY

This application claims priority to and the benefit of U.S. Provisional Patent Application No. 62/781,379, filed Dec. 18, 2018, the entire contents of which is incorporated herein by reference.

BACKGROUND

Various vehicles such as freight railroad cars in North America and other parts of the world have a car body and two spaced apart trucks. The car body or car body under frame includes two spaced apart center plates that respectively rest on and are rotatably or swivelly received by bolster bowls of the two trucks. The trucks rollingly support the car body along a path such as along railroad tracks. Each truck has a three piece truck configuration that includes two spaced apart parallel side frames and a bolster. The side frames extend in the same direction as the tracks, and the bolster extends transversely or laterally (such as perpendicularly) to the tracks. The bolster extends laterally through and between and is supported by the two spaced apart side frames. Each side frame defines a center opening and pedestal jaw openings on each side of the center opening. Each end of each bolster is supported by a spring group positioned in the center opening of the side frame and supported by the lower portion of the side frame that defines the center opening.

Each truck also includes two axles that support the side frames, four wheels, and four roller bearing assemblies respectively mounted on the ends of the axles. The truck further includes four bearing adapters respectively positioned on each roller bearing assembly in the respective pedestal jaw opening below the downwardly facing wall of the side frame that defines the top of the pedestal jaw opening. The wheel sets of the truck are thus received in bearing adapters placed in leading and trailing pedestal jaws in the side frames, so that axles of the wheel sets are generally parallel. The bearing adapters permit relatively slight angular displacement of the axles. The spring sets or groups permit the bolster to move somewhat with respect to the side frame, about longitudinal or horizontal, vertical, and transverse axes (and combinations thereof).

Directions and orientations herein refer to the normal orientation of a railroad car in use. Thus, unless the context clearly requires otherwise, the "longitudinal" axis or direction is substantially parallel to straight tracks and in the direction of movement of the railroad car on the track in either direction. The "transverse" or "lateral" axis or direction is in a horizontal direction substantially perpendicular to the longitudinal axis and the straight tracks. The "leading" side of the truck means the first side of a truck of a railroad car to encounter a turn, and the "trailing" side is opposite of the leading side. A truck is considered "square" when its wheels are aligned on parallel tracks and the axles are parallel to each other and perpendicular to the side frames.

Existing trucks do not fully address the ever increasing and expected future demands for freight railroad car truck performance in the railroad industry. More specifically, while the various current known and commercially available three piece truck configurations meet current Association of American Railroads ("AAR") specifications, enhanced specifications are being developed by the AAR and it is expected that the current three piece truck configurations may not meet these new AAR specifications. These AAR enhanced specifications set forth or codify these continuing and ongoing demands in the railroad industry for improved freight railroad car truck performance to: (a) reduce railroad car component wear and damage such as wheel wear and damage; (b) reduce rolling resistance; (c) reduce fuel consumption; (d) reduce the need for and thus cost of railroad track repair (including reducing the cost of track and tie maintenance); (e) reduce truck hunting and improve high speed stability ("HSS") for both empty and loaded railroad cars; and (f) improve curving performance for both empty and loaded railroad cars.

Ideally, on straight tracks or straight rails, a three piece truck with parallel side frames and parallel wheel set axles perpendicular to the side frames (i.e., a perfectly "square" truck) rolls without inducing lateral or transverse forces between the wheel tread and the track. However, at higher speeds, even minor imperfections or perturbations in the tracks or in the equipment can lead to a condition known as "hunting". Hunting refers to a yawing or oscillating lateral movement of the wheel sets along the tracks that causes the railroad car to move side-to-side on the tracks. More than minor imperfections or perturbations in the tracks or in the railroad car equipment or components can lead to greater truck hunting even at lower speeds. Hunting tends to increase wheel wear and damage, increase fuel consumption, increase the need for railroad track repair, and decrease HSS. In certain instances, hunting has also led to derailments, damage to the lading, and damage to the freight railroad cars.

Curved railroad tracks pose a different set of challenges for the standard three-piece truck. When a railroad car truck encounters a curve or turn, the distance traversed by the wheels on the outside of the curve is greater than the distance traversed by wheels on the inside of the curve, resulting in lateral and longitudinal forces between the respective wheels and the tracks. These wheel forces often cause the wheel set to turn in a direction opposing the curve or turn. On trucks with insufficient rigidity, this can result in a condition variously known as "warping," "lozenging," "parallelogramming," and/or "unsquaring," wherein the side frames remain parallel, but one side frame moves forward with respect to the other side frame. This condition is referred to herein as warping for brevity.

Another known issue relates to various known 3-piece railroad truck suspensions that have side frames with flat rectangular surfaces against which friction wedges are pressed to produce frictional (i.e., Coulomb) damping to control vertical bounces and other oscillatory modes. Normally, significant clearance exists between the side frame's column face and nearby surfaces of the bolster to enable assembly and proper relative motion during use. This clearance is undesirable in that it enables the truck assembly to become warped or change shape from the intended parallel and perpendicular arrangement (i.e., to undergo warping).

Such warping alone or in combination with hunting can cause increased wear on the tracks and railroad car truck components or equipment. Such warping alone or in combination with hunting also tends to increase rolling resistance that increases railroad car fuel consumption, decreases railroad car efficiency, and increases railroad engine pollution.

Various transoms for railroad car trucks have been proposed to address various of these issues. These proposed transoms have various issues.

For example, the transom proposed in U.S. Pat. No. 8,474,383 includes a cutout section in a center of the transom. The transom also includes elastomeric materials with the bushings used to connect the transom to the side frames These features affect the lateral and vertical stiffness of the transom, causing various forces acting on the wheels to be transferred to other components of the railroad car truck. These features also increase the complexity and cost of the railroad car truck.

In another example, the transom proposed in U.S. Patent Publication No. 2017/0158209 also includes a cutout section in a center of the transom. This transom is connected to the side frames via hinges at four connection points and specifically two for each side frame. The hinges enable the transom to deflect vertically. The features of this transom affect the lateral and vertical stiffness of the transom, causing various forces acting on the wheels to be transferred to other components of the railroad car truck. The features also increase the complexity and cost of the railroad car truck.

Accordingly, there is a need to meet the ongoing demands in the railroad industry for improved freight railroad car truck performance.

SUMMARY

Various embodiments of the present disclosure provide a new stabilizing transom that reduces, inhibits, and/or minimizes the truck hunting, warping, and related issues. Further various embodiments of the present disclosure provide a new railroad car truck with such stabilizing transom. Further various embodiments of the present disclosure provide a new railroad car with one or more railroad car trucks with such stabilizing transoms. In various embodiments, the railroad car truck with the stabilizing transom of the present disclosure includes a first side frame, a second side frame, a bolster, and the transom connected to the first side frame by first and second connection assemblies and to the second side frame by third and fourth connection assemblies.

More specifically, in various embodiments of the present disclosure, the railroad car truck of the present disclosure includes: (1) a first side frame; (2) a second side frame; (3) a bolster; and (4) a transom including (a) a panel assembly, (b) first and second connector assemblies connecting the panel assembly to the first side frame, and (c) third and fourth connector assemblies connecting the panel assembly to the second side frame. In various embodiments of the present disclosure, each connector assembly includes: (i) a top connection plate, (ii) a spacer connection plate, (iii) a first bottom connection plate, and (iv) a second bottom connection plate. In various embodiments of the present disclosure, each of the connection plates of each of the connector assemblies is made from a strong metal such as steel and welded to the respective side frame. In various embodiments of the present disclosure, each of the connector assemblies includes a plurality of fasteners that suitably connect that connector assembly to the respective portion of the panel assembly.

In various embodiments of the present disclosure, the transom is configured to apply opposing forces to the side frames to reduce, inhibit, and/or minimize truck hunting, warping, and other issues. More specifically, when the railroad cars starts to hunt or warp, the transom applies opposing biasing forces to the side frames to rigidly holds both side frames parallel to each other while also keeping both side frames perpendicular to the bolster, and thus reduces, inhibits, and/or minimize truck hunting as well as warping.

It should also be appreciated that although the transom of the present disclosure is not primarily intended to produce resistance against other undesired directional movements of the side frames and bolster, in various circumstances and embodiments, the transom of the present disclosure can act or co-act to permit certain directional movements and/or can act or co-act to reduce, inhibit, and/or minimize certain other undesired directional movements alone or in combination with other components of the railroad car truck. For example, the transom can be configured co-act with the bolster and bearings to provide a certain amount of resistance to undesired lateral bolster movement.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
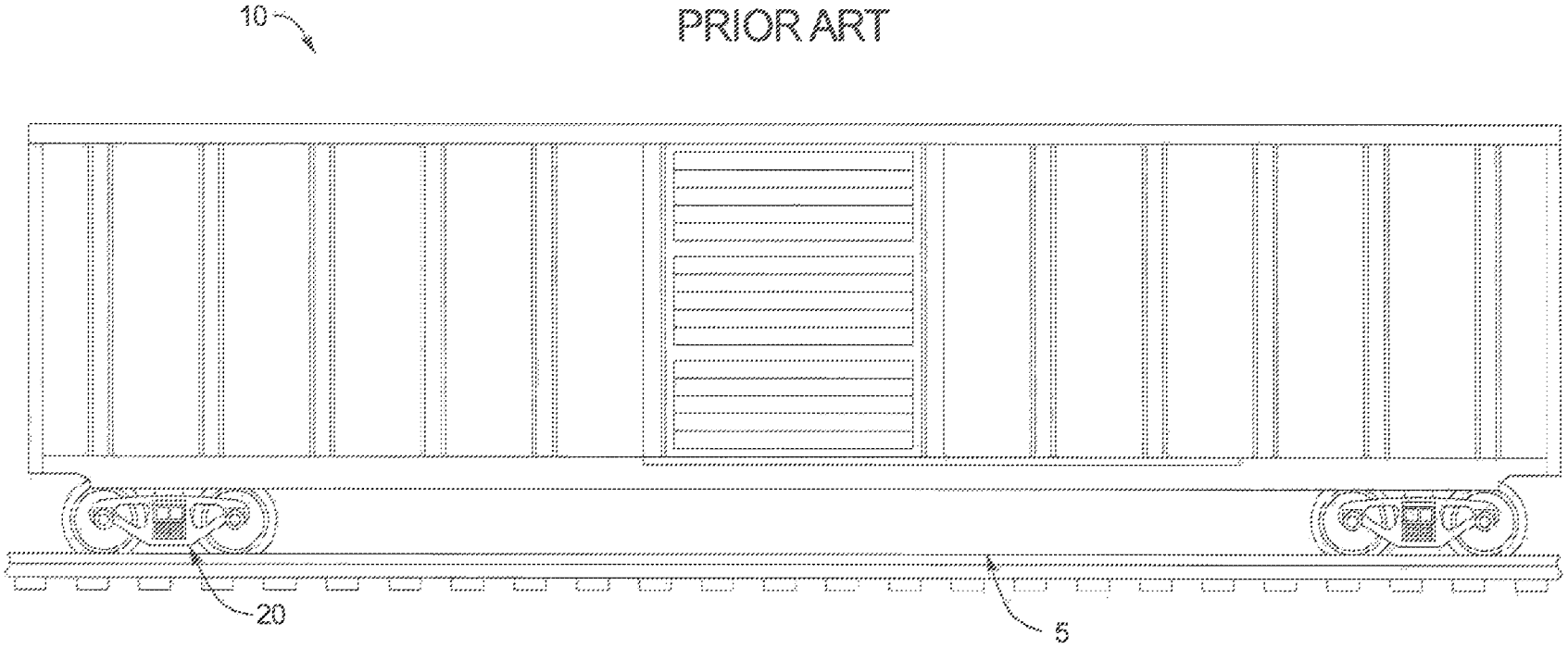
FIG. 1 PRIOR ART
FIG. 1 is a side view of a conventional freight railroad car positioned on conventional railroad tracks.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Figure 2:
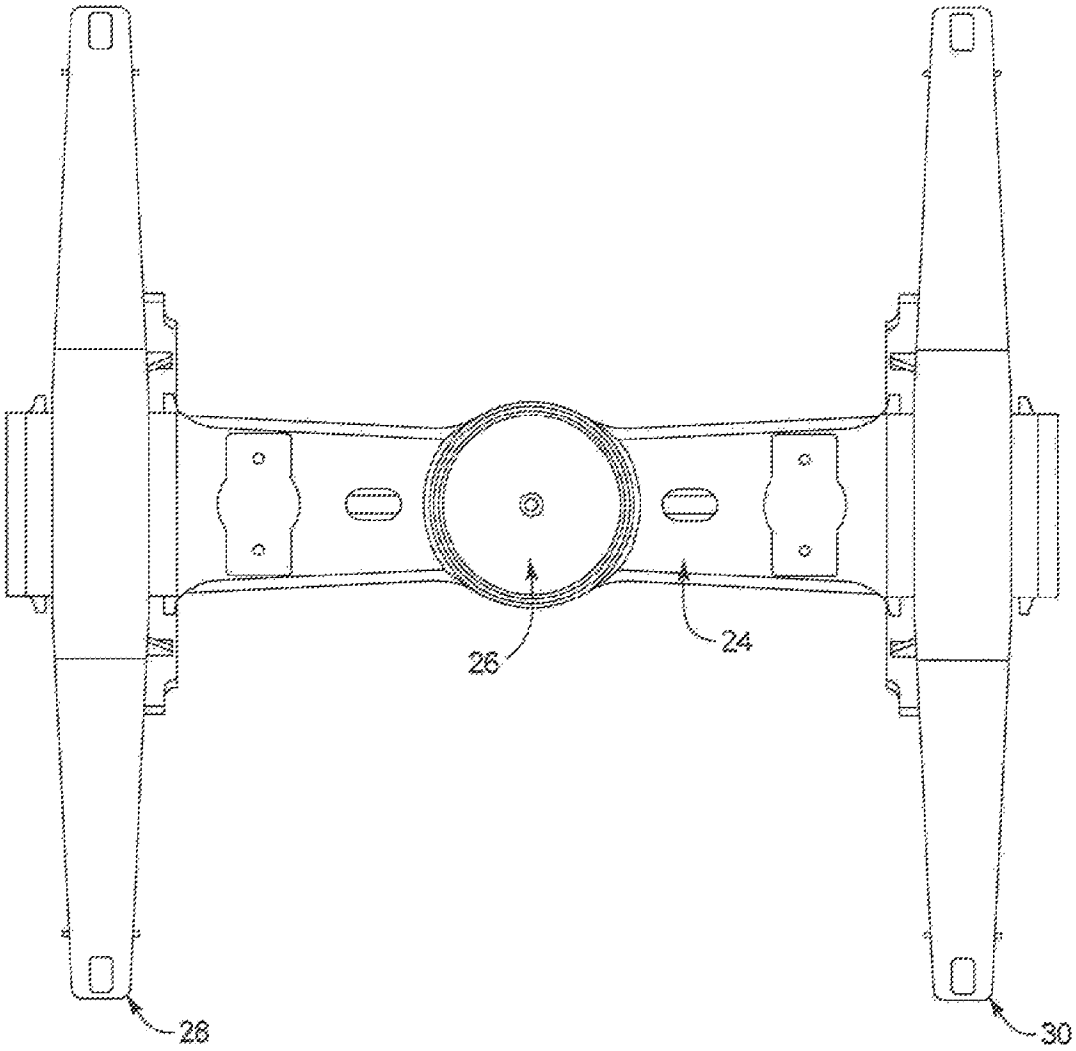
FIG. 2 PRIOR ART
FIG. 2 is a diagrammatic top view of a bolster coupled to two spaced side frames of a conventional freight railroad car truck.

Referring now to the drawings and particularly to FIGS. 1 and 2, a vehicle such as a conventional railroad car truck that is generally indicated by numeral 20 is shown with respect to freight railroad car 10 configured to roll along railroad tracks 5. The conventional truck 20 includes a bolster 24, a bolster bowl 26 of the bolster 24, a first side frame 28, and a second side frame 30. Generally, the bolster 24 extends transversely to the direction of the railroad tracks 5, and the side frames 28 and 30 extend longitudinally in the same direction as the railroad tracks 5.

Referring now to FIGS. 3, 4, 5, 6, 7, 7A, 8, and 8A, one example embodiment of a stabilizing transom of the present disclosure, and particularly in this example embodiment, a railroad car truck with an example stabilizing transom of the present disclosure is shown and generally indicated by numeral 50. It should be appreciated that the stabilizing transom of the present disclosure can be employed in other vehicles or trucks other than railroad cars and railroad car trucks.

Figure 3:
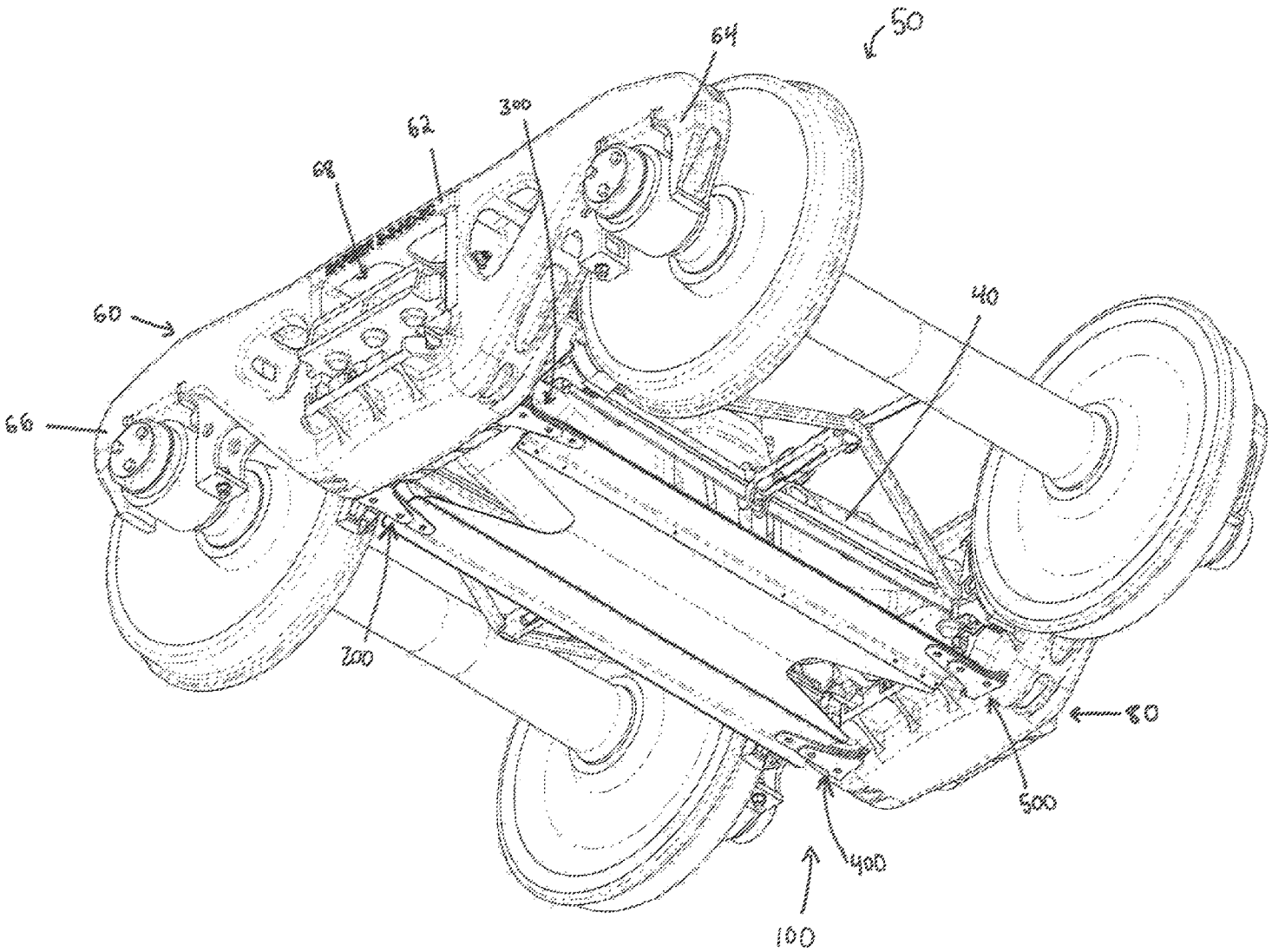
FIG. 3 is a bottom perspective view of a railroad car truck of one example embodiment of the present disclosure, and showing an example transom of the present disclosure connected to the side frames of the railroad car truck.
Figure 4:
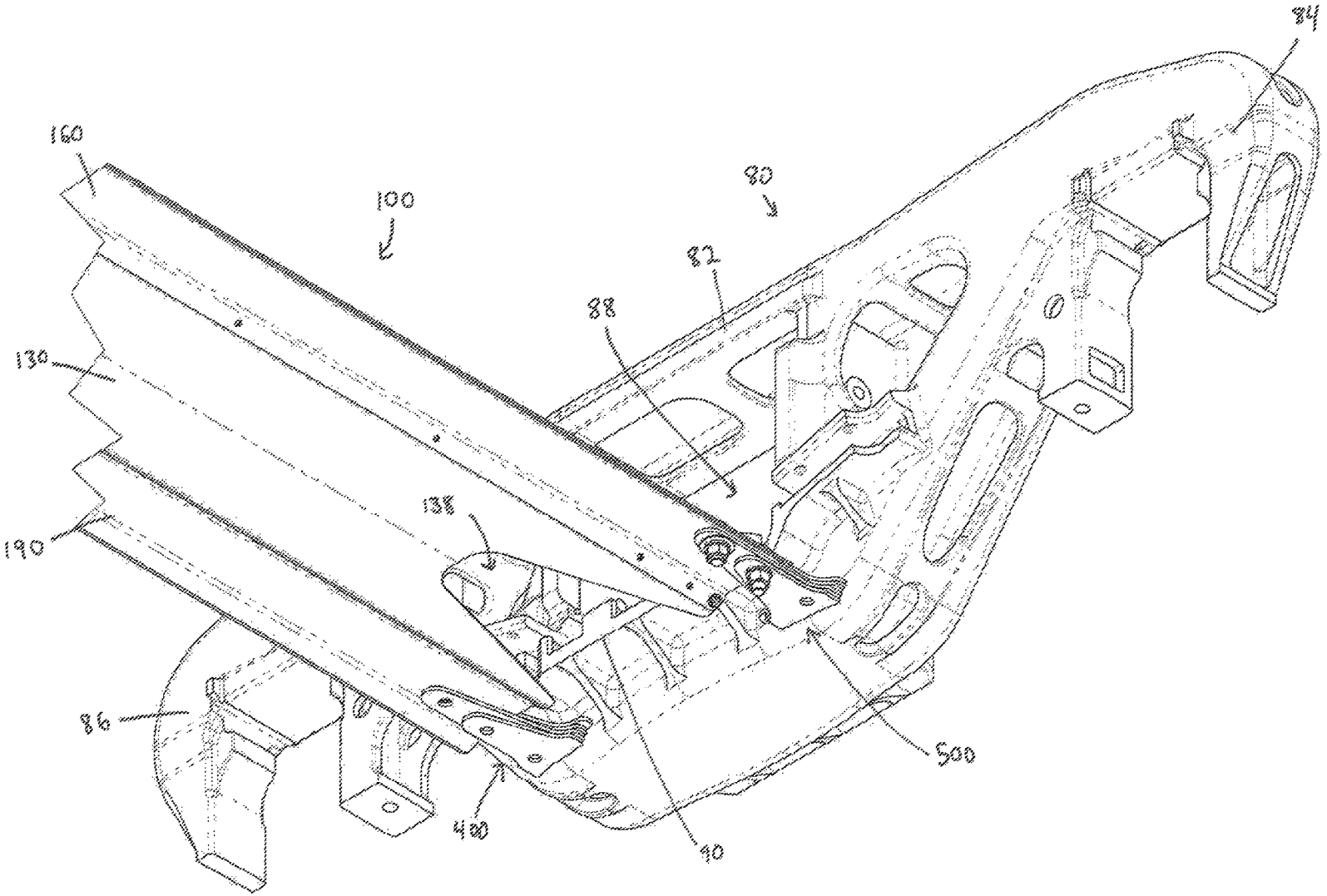
FIG. 4 is an enlarged fragmentary bottom perspective view of part of the railroad car truck of FIG. 3, and showing part of the example transom of FIG. 3 connected to one of the side frames of the railroad car truck.
Figure 5:
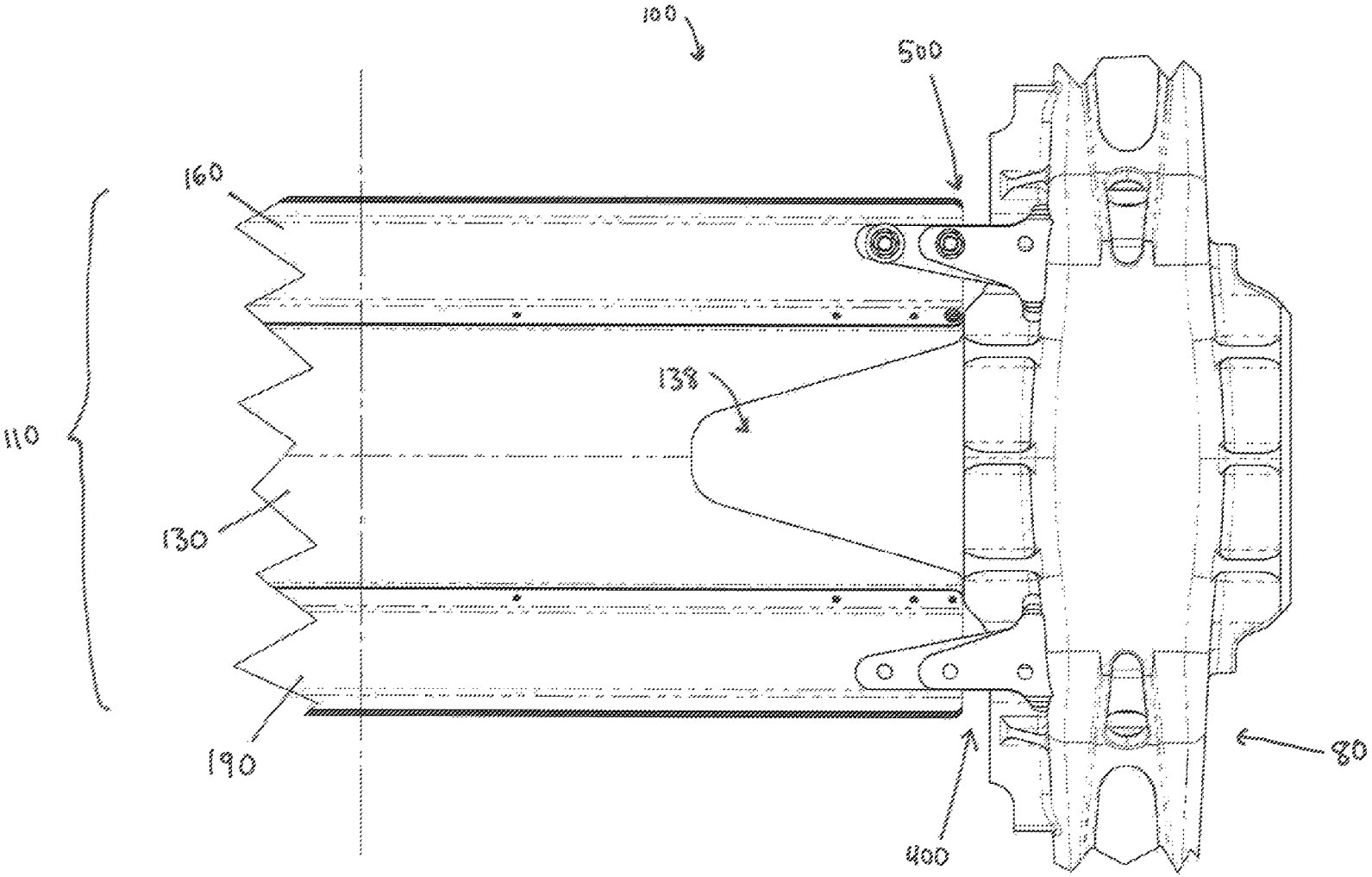
FIG. 5 is an enlarged fragmentary bottom view of part of the railroad car truck of FIG. 3, and showing part of the example transom of FIG. 3 connected to one of the side frames of the railroad car truck.
Figure 6:
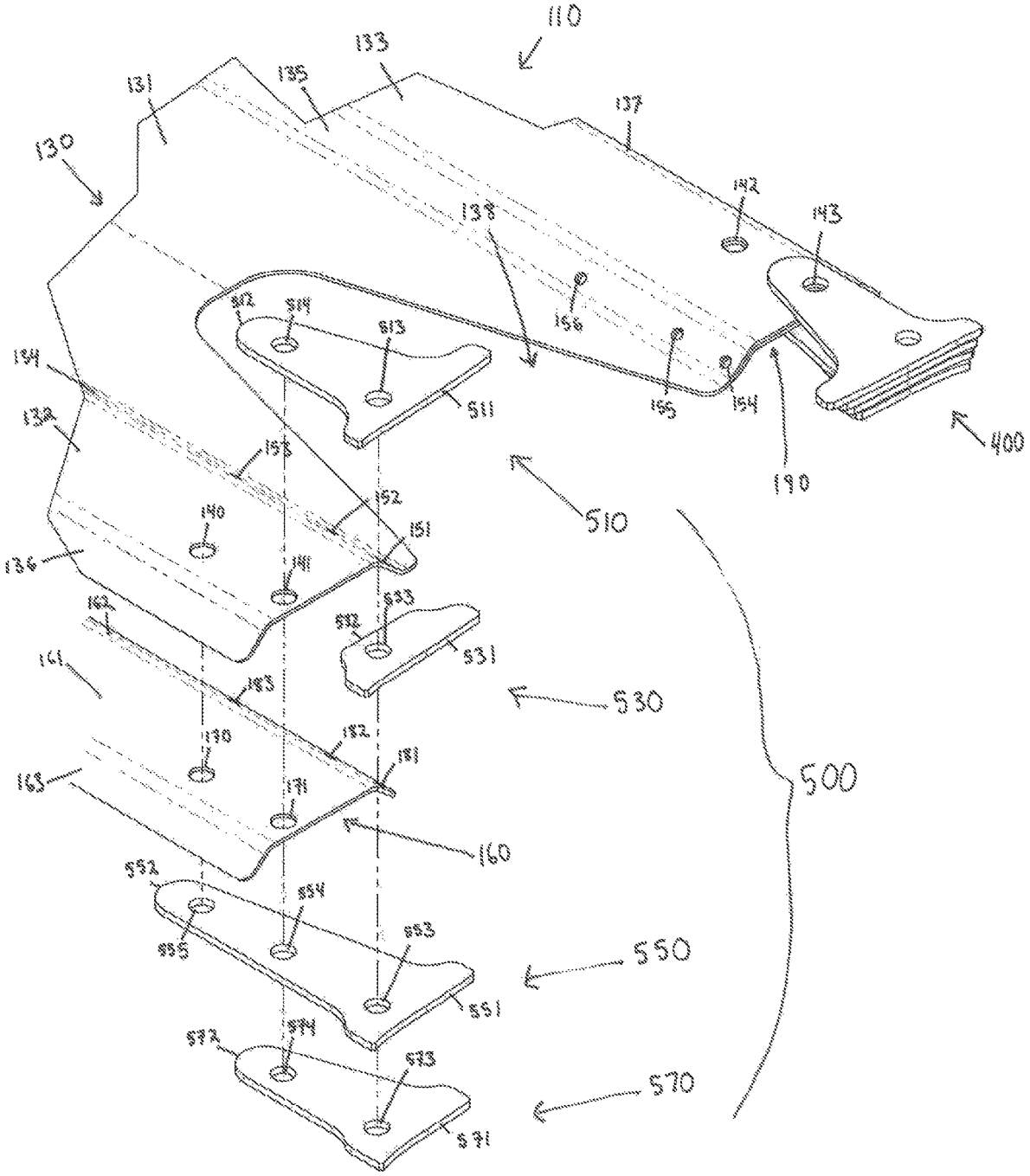
FIG. 6 is an enlarged fragmentary partially exploded top perspective view of part of the example transom of FIG. 3.

In this illustrated example embodiment of the present disclosure, the railroad car truck 50 includes a bolster 40, a first side frame 60, and a second side frame 80. These features are best shown in FIG. 3. Generally, the bolster 40 is configured to extend transversely to the direction of the railroad tracks (not shown in FIG. 3), and the side frames 60 and 80 are configured to extend longitudinally in the same direction as the railroad tracks (not shown in FIG. 3).

The side frame 60 includes: (a) a longitudinally extending body 62; and (b) two downwardly extending pedestal jaws (including a first pedestal jaw 64 and a second pedestal jaw 66) on opposite sides of a center opening 68 defined by the body 62 of the side frame 60.

Likewise, the side frame 80 includes: (a) a longitudinally extending body 82; and (b) two downwardly extending pedestal jaws (including a first pedestal jaw 84 and a second pedestal jaw 86) on opposite sides of a center opening 88 defined by the body 82 of the side frame 80. The side frame 80 also includes a spring seat 90. These features are occluded in FIG. 3, and best shown in FIG. 4.

In this illustrated example embodiment of the present disclosure, the railroad car truck 50 includes an example transom 100 connected to the side frame 60 and connected to the side frame 80. The transom 100 extends between the side frame 60 and the side frame 80.

In this illustrated example embodiment, the transom 100 generally includes: (1) a panel assembly 110; (2) a first connector assembly 200 connecting the panel assembly 110 to the first side frame 60; (3) a second connector assembly 300 connecting the panel assembly 110 to the first side frame 60; (4) a third connector assembly 400 connecting the panel assembly 110 to the second side frame 80; and (5) a fourth connector assembly 500 connecting the panel assembly 110 to the second side frame 80.

More specifically, In this illustrated example embodiment, the panel assembly 110 includes a main body transom plate 130, a first channel transom plate 160, and a second channel transom plate 190.

The main body transom plate 130 is connected or coupled to the first connector assembly 200, the second connector assembly 300, the third connector assembly 400, and the fourth connector assembly 500 as further described below.

In this illustrated example embodiment, the main body transom plate 130 includes: (a) a generally flat central portion 131, (b) a first raised portion 132, (c) a second raised portion 133, (d) a first angled connecting portion 134 that connects the central portion 131 to the first raised portion 132, (e) a second angled connecting portion 135 that connects the central portion 131 to the second raised portion 133, (f) a third angled portion 136, and (g) a fourth angled portion 137.

In this illustrated example embodiment, the central portion 131 defines a first tapered cutout 138 extending from a first side of the main body transom plate 130 connected to the first side frame 60 via the first connector assembly 200 and the second connector assembly 300. The central portion 131 includes a second tapered cutout (not shown in FIGS. 4, 5, and 6) mirroring the first tapered cutout 138. The second tapered cutout extends from a second side of the main body transom plate 130 connected to the second side frame 80 via the third connector assembly 400 and the fourth connector assembly 500. In this illustrated example embodiment, each tapered cutout is wider at the edge of the main body transom plate 130, and narrows toward the center of the main body transom plate 130 in the transverse direction extending between the side frames 60 and 80. As such, the main body transom plate 130 including the cutouts forms a modified "X" shape when viewed from above or below.

The first raised portion 132 of the main body transom plate 130 defines first and second apertures 140 and 141. The apertures 140 and 141 are spaced apart along a lateral axis of the first raised portion 132. The apertures 140 and 141 are dual purpose apertures. Specifically, they are configured to receive a protruding alignment finger of a jig such as the jig 1000 as discussed below, and then configured to receive a fastener to affix the main body transom plate 130 to the first channel transom plate 160 and the fourth connector assembly 500. The apertures 140 and 141 are aligned with one or more apertures of the fourth connector assembly 500.

The first raised portion 132 of the main body transom plate 130 also defines spaced apart third and fourth apertures (not shown). The third and fourth apertures may be similar or identical to apertures 140 and 141, but are positioned on the opposite end of the first raised portion 132 from the first and second apertures 140 and 141. The third and fourth apertures are aligned with one or more apertures of the second connector assembly 300.

The second raised portion 133 of the main body transom plate 130 defines spaced apart fifth and sixth apertures 142 and 143. The apertures 142 and 143 may be similar or identical to apertures 140 and 141 described above. The apertures 142 and 143 are aligned with one or more apertures of the third connector assembly 400.

The second raised portion 133 of the main body transom plate 130 also defines spaced apart seventh and eighth apertures (not shown). The seventh and eighth apertures may be similar or identical to apertures 142 and 143, but are positioned on the opposite end of the second raised portion 133 from the fifth and sixth apertures 142 and 143. The seventh and eighth apertures are aligned with one or more apertures of the first connector assembly 200.

The first angled connecting portion 134 defines a first plurality of channel connecting apertures 151, 152, and 153. The channel connecting apertures 151, 152, and 153 are positioned proximate the side of the main body transom plate 130 near the fourth connector assembly 500. The apertures 151, 152, and 153 are spaced apart along the length of the first angled connecting portion 134. The apertures 151, 152, and 153 are aligned with corresponding apertures on the first channel transom plate 160.

The first angled connecting portion 134 also defines a second plurality of channel connecting apertures (not shown) that mirror the first plurality of apertures 151, 152, and 153. The second plurality of channel connecting apertures are positioned proximate the side of the main body transom plate 130 near the second connector assembly 300. The second plurality of channel connecting apertures are spaced apart along the length of the first angled connecting portion 134. The second plurality of apertures are aligned with corresponding apertures on the first channel transom plate 160.

The second angled connecting portion 135 defines a third plurality of channel connecting apertures 154, 155, and 156. The channel connecting apertures 154, 155, and 156 are positioned proximate the side of the main body transom plate 130 near the third connector assembly 400. The apertures 154, 155, and 156 are spaced apart along the length of the second angled connecting portion 135. The apertures 154, 155, and 156 are aligned with corresponding apertures on the second channel transom plate 190.

The second angled connecting portion 135 also defines a fourth plurality of channel connecting apertures (not shown) that mirror the third plurality of apertures 154, 155, and 156. The fourth plurality of channel connecting apertures are positioned proximate the side of the main body transom plate 130 near the first connector assembly 200. The fourth plurality of channel connecting apertures are spaced apart along the length of the second angled connecting portion 135. The fourth plurality of apertures are aligned with corresponding apertures on the second first channel transom plate 190.

The third angled portion 136 extends from the first raised portion 132 at a downward angle.

The fourth angled portion 137 extends from the second raised portion 133 at a downward angle.

Each of the (a) first raised portion 132, (b) second raised portion 133, (c) first angled connecting portion 134, (d) second angled connecting portion 135, (e) third angled portion 136, and (f) fourth angled portion 137 extends from a first side of the main body transom plate 130 to a second side of the main body transom plate 130 (i.e., extending all the way from the connection with the first side frame 60 to the connection with the second side frame 80).

The first channel transom plate 160 extends laterally between the fourth connector assembly 500 and the second connector assembly 300. The first channel transom plate 160 includes a first raised portion 161, a first angled portion 162, and a second angled portion 163. The first raised portion 161, first angled portion 162, and second angled portion 163 are sized and spaced to match the sizing and spacing of the first raised portion 132, first angled connecting portion 134, and third angled portion 136 of the main body transom plate 130. In this way, the first channel transom plate 160 matches a contour of the main body transom plate 130.

The first channel transom plate 160 also defines first and second dual purpose apertures 170 and 171. The apertures 170 and 171 are configured to receive a protruding alignment finger of a jig such as the example jig 1000 discussed below. The apertures 170 and 171 are configured to receive a fastener to affix the main body transom plate 130 to the first channel transom plate 160 and the fourth connector assembly 500. The apertures 170 and 171 are aligned with apertures 140 and 141 of the main body transom plate 130, as well as one or more apertures of the fourth connector assembly 500.

The first channel transom plate 160 also defines third and fourth dual purpose apertures (not shown). The third and fourth apertures may be similar or identical to the first and second apertures 170 and 171, but are positioned on the opposite end of the first channel transom plate 160 from the first and second apertures 170 and 171. The third and fourth apertures are aligned with the third and fourth apertures of the first raised portion 132, as well as one or more apertures of the second connector assembly 300.

The first channel transom plate 160 also defines a first plurality of channel connection apertures 181, 182, and 183. The channel connection apertures 181, 182, and 183 are positioned on the first angled portion 162, near the fourth connector assembly 500. The apertures 181, 182, and 183 are spaced apart along the length of the first angled portion 162. The apertures 181, 182, and 183 are aligned with corresponding apertures 151, 152, and 153 of the first angled connecting portion 134 of the main body transom plate 130.

The first channel transom plate 160 also defines a second plurality of channel connection apertures (not shown) that mirror apertures 181, 182, and 183. The second plurality of channel connection apertures are positioned proximate the side of the first channel transom plate 160 near the second connector assembly 300. The second plurality of channel connection apertures are spaced apart along the length of the first angled portion 162. The second plurality of apertures are aligned with corresponding apertures on the main body transom plate 130.

The second channel transom plate 190 may be similar or identical to the first channel transom plate 160. Alternatively, the second channel transom plate 190 may be a mirror image of the first channel transom plate. Further alternatively, the second channel transom plate 190 may be otherwise different than the first channel transom plate.

In the illustrated example embodiment, the second channel transom plate 190 extends laterally between the third connector assembly 400 and the first connector assembly 200. The second channel transom plate 190 includes a first raised portion, a first angled portion, and a second angled portion. The first raised portion, first angled portion, and second angled portion are sized and spaced to match the sizing and spacing of the second raised portion 133, second angled connecting portion 135, and fourth angled portion 137 of the main body transom plate 130. In this way, the second channel transom plate 190 matches a contour of the main body transom plate 130.

The second channel transom plate 190 also defines fifth and sixth dual purpose apertures. The fifth and sixth dual purpose apertures are configured to receive a protruding alignment finger of a jig such as the jig 1000 discussed below. The fifth and sixth dual purpose apertures are configured to receive a fastener to affix the main body transom plate 130 to the second channel transom plate 190 and the third connector assembly 400. The fifth and sixth apertures are aligned with the apertures 142 and 143 of the main body transom plate 130, as well as one or more apertures of the third connector assembly 400.

The second channel transom plate 190 also defines seventh and eighth dual purpose apertures (not shown). The seventh and eighth apertures may be similar or identical to the fifth and sixth apertures, but are positioned on the opposite end of the second channel transom plate 190 from the fifth and sixth apertures. The seventh and eighth apertures are aligned with the seventh and eighth apertures of the second raised portion 133, as well as one or more apertures of the first connector assembly 200.

The second channel transom plate 190 also defines a third plurality of channel connection apertures. The third plurality of channel connection apertures are positioned on the first angled portion of the second channel transom plate, near the third connector assembly 400. The third plurality of apertures are spaced apart along the length of the first angled portion of the second channel transom plate 190. The third plurality of apertures are aligned with corresponding apertures 154, 155, and 156 of the second angled connecting portion 135 of the main body transom plate 130.

The second channel transom plate 190 also defines a fourth plurality of channel connection apertures (not shown) that mirror the third plurality of channel connection apertures. The fourth plurality of channel connection apertures are positioned proximate the side of the second channel transom plate 190 near the first connector assembly 200. The fourth plurality of channel connection apertures are spaced apart along the length of the first angled portion of the second channel transom plate 190. The fourth plurality of apertures are aligned with corresponding apertures on the main body transom plate 130.

In this illustrated example embodiment, each piece of the panel assembly 110 of the transom 100 is made from a suitable relatively thin steel (e.g., 11 gauge high-strength steel) with several acute bends to provide stiffness against catenary curvature, or other suitable high-strength material. It should be appreciated that the panel assembly of the transom can be made from other suitable materials and in other suitable sizes and configurations.

In this illustrated example embodiment, the first connector assembly 200, the second connector assembly 300, the third connector assembly 400, and the fourth connector assembly 500 are identical. However, it should be appreciated that the first connector assembly 200, the second connector assembly 300, the third connector assembly 400, and the fourth connector assembly 500 do not need to be identical in accordance with the present disclosure. For brevity, only the fourth connector assembly 500 is described in detail herein.

In this illustrated example embodiment, the fourth connector assembly 500 includes: (1) a top connection plate 510; (2) a spacer plate 530; (3) a bottom connection plate 550; and (4) a bottom support plate 570.

In the illustrated example embodiment, the top connection plate 510 includes a flat body having a side frame connection edge 511 and a free edge 512. The side frame connection edge 511 and the free edge 512 are spaced apart. The top connection plate 510 has a generally uniform thickness. The body of the top connection plate 510 is tapered such that the side frame connection edge 511 is wider than the free edge 512.

The body of the top connection plate 510 defines a first jig-receiving aperture 513 and a second dual-purpose aperture 514 spaced apart from the first aperture 513. The jig receiving aperture 513 is configured to receive a protruding alignment finger of a jig such as the jig 1000 discussed below. The dual-purpose aperture 514 is configured to receive a protruding alignment finger of the jig 1000 during the process of attaching the top connection plate to the second side frame 80. Thereafter, the dual-purpose aperture 514 is configured to receive a fastener to affix the top connection plate 510 to the main body transom plate 130. The first aperture 513 is aligned with the apertures 533, 553, and 573 of the spacer plate 530, bottom connection plate 550, and bottom support plate 570 respectively. The second aperture 514 is aligned with the apertures 141 and 171 of the main body transom plate 130 and first channel transom plate 160, as well as the apertures 554 and 574 of the bottom connection plate 550 and bottom support plate 570.

In the illustrated example embodiment, the spacer plate 530 includes a flat body having a side frame connection edge 531 and a free edge 532. The side frame connection edge 531 and the free edge 532 are spaced apart. The spacer plate 530 has a generally uniform thickness. The body of the spacer plate 530 is tapered such that the side frame connection edge 531 is wider than the free edge 532.

The body of the spacer plate 530 defines a jig-receiving aperture 533. The jig receiving aperture 533 is configured to receive a protruding alignment finger of the jig 1000 during the process of attaching the spacer plate 530 to the second side frame 80 as discussed below. The jig receiving aperture 533 is aligned with the apertures 513, 553, and 573 of the top connection plate 510, bottom connection plate 550, and bottom support plate 570 respectively.

In the illustrated example embodiment, the spacer plate 530 provides spacing between the top connection plate 510 and the bottom connection plate 550. The spacer plate 530 has the same or similar thickness as the combined thickness of the main body transom plate 130 and the first channel transom plate 160 at the edge proximate the fourth connector assembly 500. This enables the main body transom plate 130 and the first channel transom plate 160 to fit in between the top connection plate 510 and the bottom connection plate 550. In various embodiments of the present disclosure, when fully assembled, there is a gap between the free edge of the spacer plate and the outboard edge of the transom plate assembly. This gap enables the transom plate assembly to be biased toward either side frame a distance sufficient to allow each of its outboard edges to be inserted between the respective opposing connector plate assemblies during manufacture.

In the illustrated example embodiment, the bottom connection plate 550 includes a flat body having a side frame connection edge 551 and a free edge 552. The side frame connection edge 551 and the free edge 552 are spaced apart. The bottom connection plate 550 has a generally uniform thickness. The body of the bottom connection plate 550 is tapered such that the side frame connection edge 551 is wider than the free edge 552.

The body of the bottom connection plate 550 defines a first jig-receiving aperture 553, a second dual-purpose aperture 554, and a third transom connection aperture 555. The apertures 553, 554, and 555 are spaced apart from each other. The jig receiving aperture 553 is configured to receive a protruding alignment finger of the jig 1000 discussed below. The dual-purpose aperture 554 is configured to receive a protruding alignment finger of a jig such as the jig 1000 during the process of attaching the bottom connection plate to the second side frame 80. The dual-purpose aperture 554 is configured to receive a fastener to affix the bottom connection plate 550 to the first channel transom plate 160. The transom connection aperture 555 is also configured to receive a fastener to affix the bottom connection plate 550 to the first channel transom plate 160. The jig-receiving aperture 553 is aligned with the apertures 513, 533, and 573 of the top connection plate 510, spacer plate 530, and bottom support plate 570 respectively. The dual-purpose aperture 554 is aligned with the apertures 141 and 171 of the main body transom plate 130 and first channel transom plate 160, as well as the apertures 514 and 574 of the top connection plate 510 and bottom support plate 570. The transom connection aperture 555 is aligned with the apertures 140 and 170 of the main body transom plate and first channel transom plate.

In the illustrated example embodiment, the bottom support plate 570 includes a flat body having a side frame connection edge 571 and a free edge 572. The side frame connection edge 571 and the free edge 572 are spaced apart. The bottom support plate 570 has a generally uniform thickness. The body of the bottom support plate 570 is tapered such that the side frame connection edge 571 is wider than the free edge 572. This configuration can reduce vertical bending stresses that may be produced due to swinging motion, such that such stresses are not concentrated at the connection edge.

The body of the bottom support plate 570 defines a first jig-receiving aperture 573 and a second dual-purpose aperture 574 spaced apart from the first aperture 573. The jig-receiving aperture 573 is configured to receive a protruding alignment finger of the jig 1000 discussed below. The dual-purpose aperture 574 is configured to receive a protruding alignment finger of a jig such as the jig 1000 during the process of attaching the bottom connection plate 570 to the second side frame 80. The dual-purpose aperture 574 is also configured to receive a fastener to affix the bottom support plate 570 to the bottom connection plate 550. The first aperture 573 is aligned with the apertures 513, 533, and 553 of the top connection plate 510, spacer plate 530, and bottom connection plate 550 respectively. The second aperture 574 is aligned with the apertures 141 and 171 of the main body transom plate 130 and first channel transom plate 160, as well as the apertures 514 and 554 of the top connection plate 510 and bottom connection plate 550.

Figure 7:
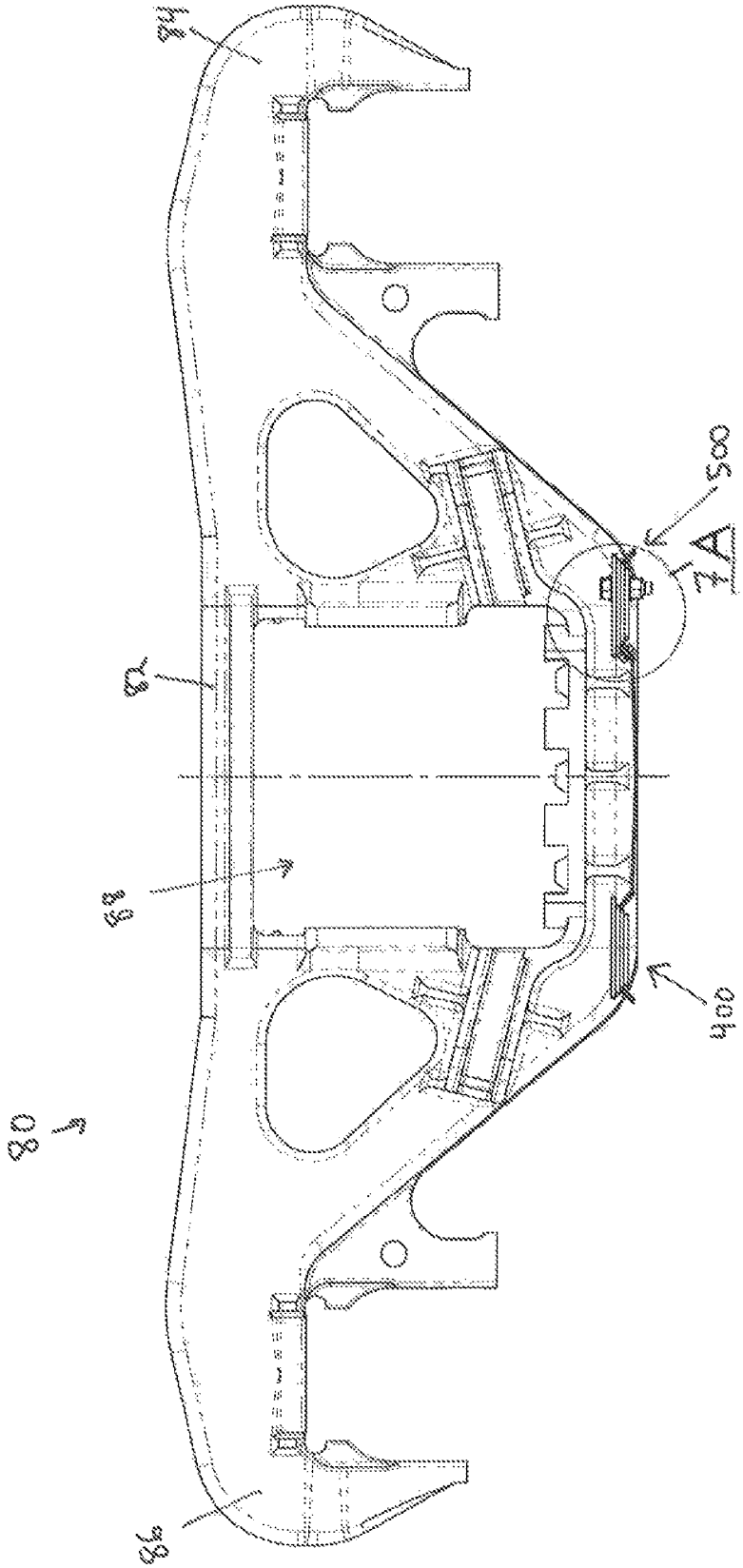
FIG. 7 is an enlarged side view of part of the railroad car truck of FIG. 3, and showing part of the example transom of FIG. 3 connected to one of the side frames of the railroad car truck.
Figure 7A:
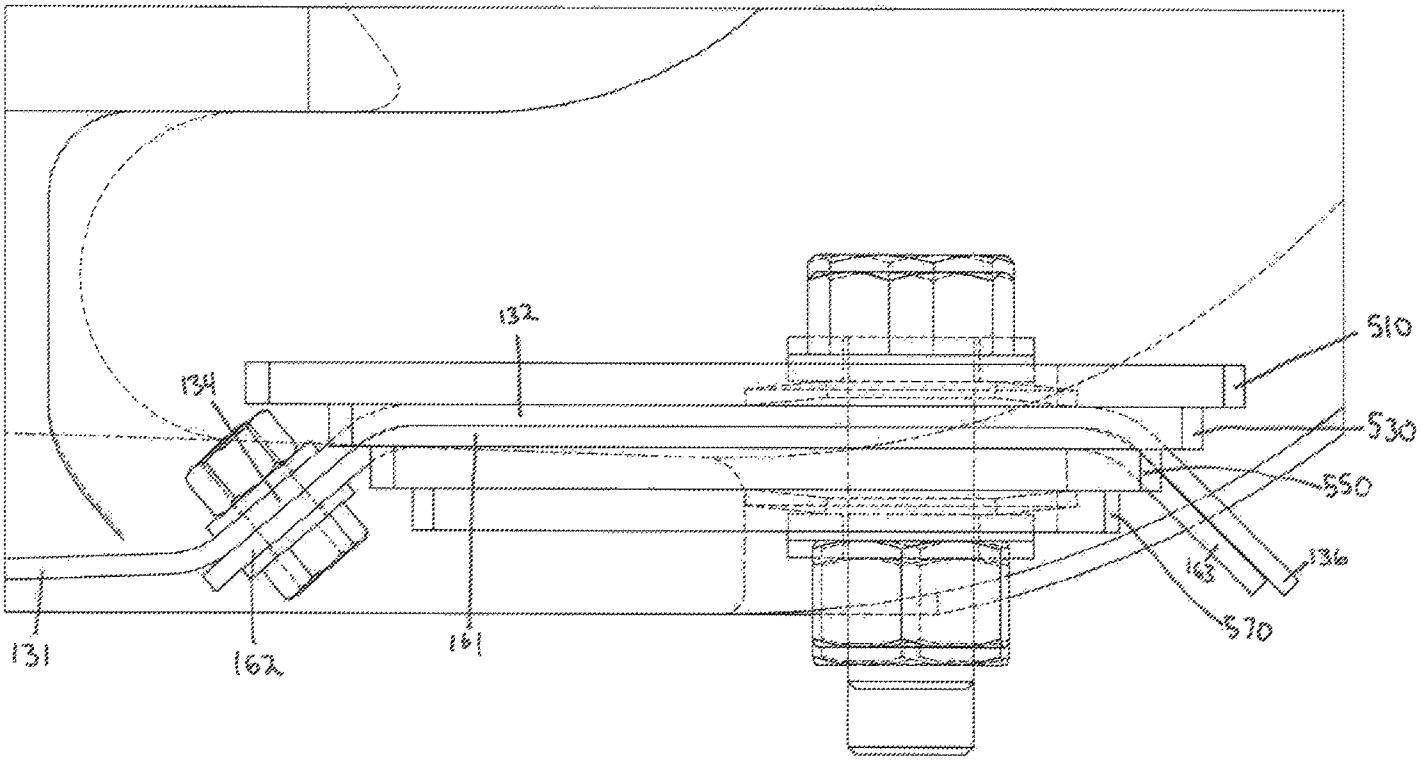
FIG. 7A is an enlarged side view of the Section A of FIG. 7.
Figure 8:
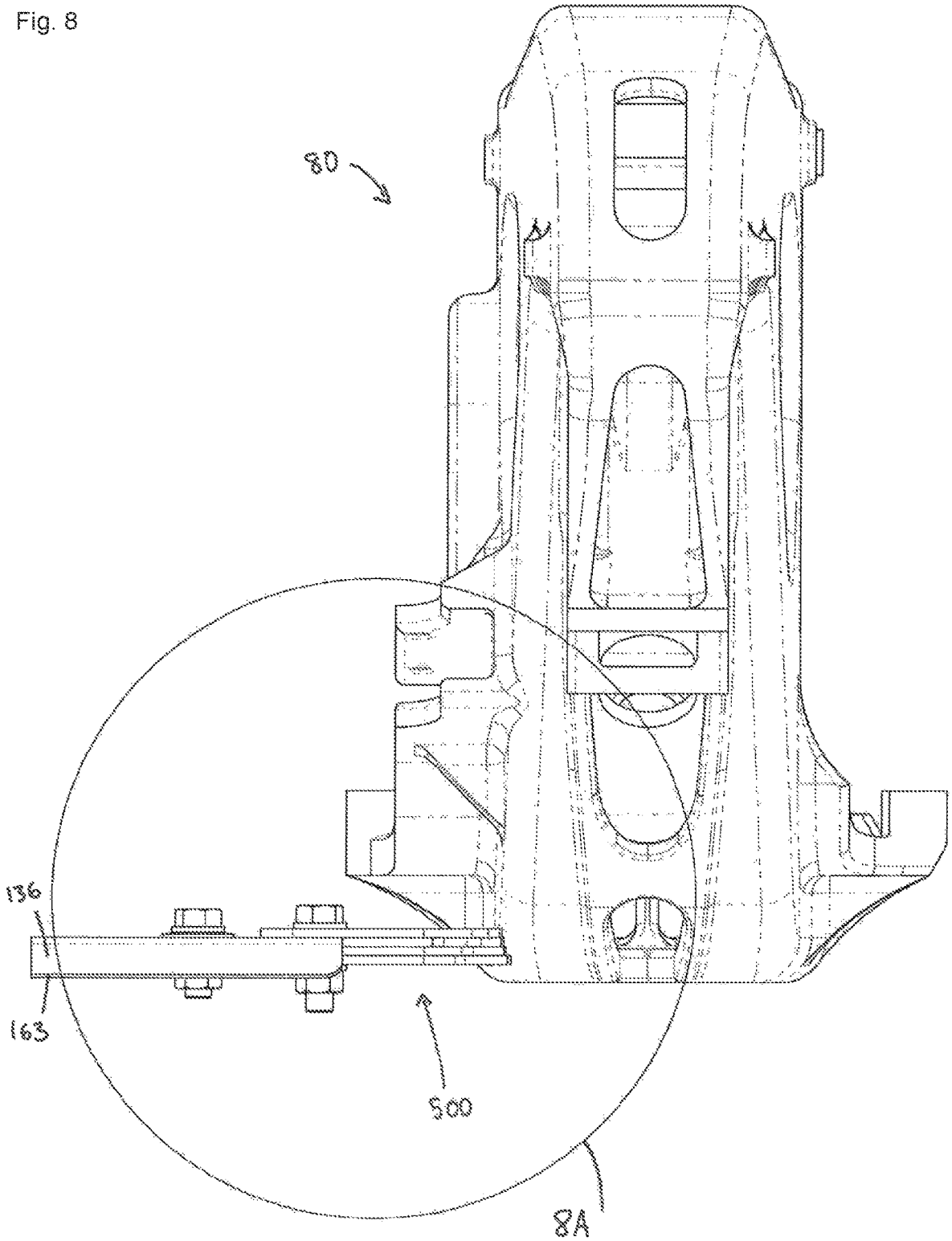
FIG. 8 is an enlarged end view of part of the railroad car truck of FIG. 3, and showing part of the example transom of FIG. 3 connected to one of the side frames of the railroad car truck.
Figure 8A:
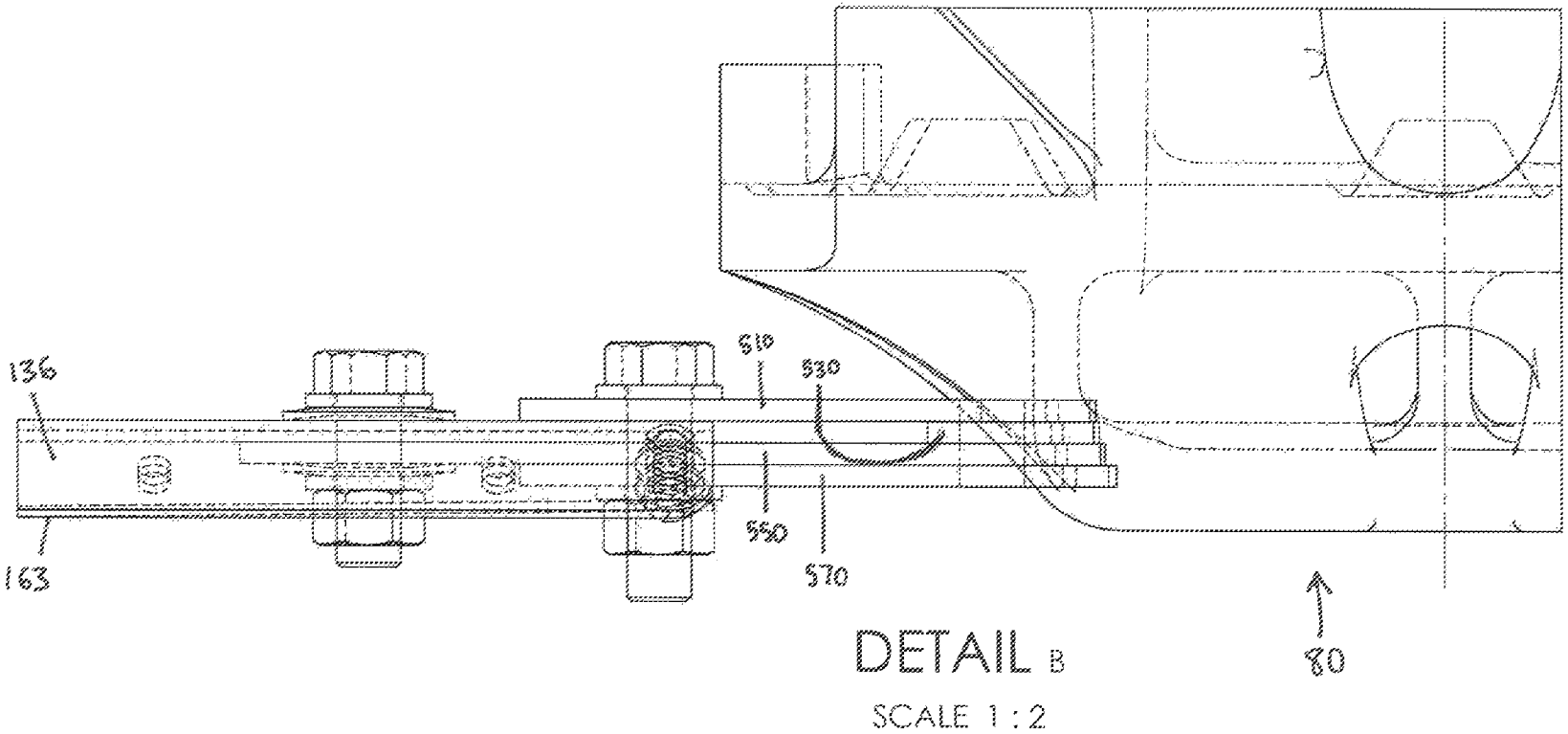
FIG. 8A is an enlarged side view of the Section B of FIG. 8.

In the illustrated example embodiment, the respective widths of connection plate side frame connection edges (511, 531, 551, and 571) decreases from top to bottom. This is best shown in FIG. 7A. Specifically, side frame connection edge 511 of top connection plate 510 is wider than side frame connection edge 531 of spacer plate 530, which is wider than side frame connection edge 551 of bottom connection plate 550, which is wider than side frame connection edge 571 of bottom support plate 570. This configuration increases the available edge or perimeter area for the application of the weld.

In the illustrated example embodiment, the respective plates of the connectors 200, 300, 400, and 500 of the transom 100 are made from a suitably strong metal such as steel. It should be appreciated that the connector plates of the transom 100 can be made from other suitable materials and in other suitable sizes and configurations.

In the illustrated example embodiment, the outer edges or end portions of each of the plates 510, 530, 550, and 570 are each welded or otherwise immovably fastened to the side frame 80. Two or more of these plates may also be welded to each other. The plates are affixed to the side frame horizontally, such that the apertures defined by the bodies of the plates align in a vertical direction perpendicular to the track. The plates 510, 530, 550, and 570 are affixed to the side frame 80 below the center opening 88. The plates 510, 530, 550, and 570 are affixed to the side frame 80 below the spring seat 90.

The respective fasteners extend through each set of aligned apertures to connect the main body transom plate 130 to the first channel transom plate 160, and to connect the main body transom plate 130 to the second channel transom plate 190. In particular, a first fastener extends through each set of channel connecting apertures of the main body transom plate 130 and first channel transom plate 160 (e.g., 151 and 181, 152 and 182, and 153 and 183). Similarly, a second fastener extends through the other sets of channel connection apertures disclosed herein to connect the first channel transom plate 160 to the main body transom plate 130, and to connect the second channel transom plate 190 to the main body transom plate 130. The fasteners may be any suitable fasteners.

Respective fasteners also extend through each set of aligned apertures to connect the connector assembly 500 to the panel assembly 110. In particular, a first fastener extends through the apertures 140, 170, and 555. A second fastener extends through the apertures 141, 171, 514, 554, and 574. Other fasteners extend through corresponding apertures of connector assemblies 200, 300, and 400, as well as the other sections of the panel assembly 110 including dual-purpose or transom connection apertures.

In this illustrated example embodiment, the fasteners of the connector assemblies 200, 300, 400, and 500 of the transom 100 are made from a suitably strong metal such as steel. It should be appreciated that the fasteners of the connector assemblies of the transom can be made from other suitable materials and in other suitable sizes and configurations.

It should be appreciated from the above that the panel assembly 110 is connected to the four connector assemblies 200, 300, 400, and 500, and is thereby is connected to the first and second side frames 60 and 80. The transom 100 extends transversely relative to the side frames 60 and 80 and in the same transverse direction as the bolster 40.

It should be appreciated from the above, that when the railroad car truck bolster 40 starts to hunt, the transom 100 acts to counter this hunting by providing increased warp stiffness in the plane of the transom 100. The increased warp stiffness acts to reduce the ability of the wheels of the truck to move out of alignment or become warped or un-squared. In other words, the transom 100 and its connection to the side frames 60 and 80 increases the warp stiffness of the truck, reducing the ability of the wheels to become unsquared or come out of alignment.

It should be understood that embodiments described herein also enable the transom to bend, twist, or move in other directions aside from within the plane of the transom. For example, various embodiments of the present disclosure enable the transom to twist about the long axis (i.e., the axis extending from the side frame 60 to the side frame 80). Various Embodiments of the present disclosure also enable the lateral swing of both side frames together, and buckling or bending along the long axis of the transom. These movements can be beneficial under real world conditions which may include, for example, inclined terrain, aberrations in the rails, non-identical side frames or side frame movements, and when curvature is induced by the positioning and orientation of the transom and/or connector assemblies.

The transom of the present disclosure also accounts for certain lateral motion sources in or on the railroad car truck. For example, there are various support points at which the side frames rest on the respective bearings of or for each axle. The center of action of certain lateral bolster movement is below these support points which allows for a pendulum-like "swinging" movement (somewhat similar to a glider-style rocking chair). In various embodiments of the present disclosure, the transom is configured to be flexible enough to allow for and not resist this swinging movement. In other embodiments of the present disclosure, the stiffness of the transom is at a level that produces certain amounts of desired resistance to such swinging movement.

The present disclosure thus contemplates that the transom can be configured to withstand certain of the swinging movement up to a theoretical maximum excursion.

The present disclosure contemplates that the transom cannot practically be made to entirely resist this swinging displacement. More specifically, the present disclosure contemplates that it may be undesirable and unreasonable for the transom to structurally entirely resist the swinging because: (1) the swinging movement is desirable since it dissipates certain amounts of energy and thereby protects the railcar and its cargo; (b) the transom and its connectors would have to be extremely massive to actually limit the swing movement; and (c) that massiveness may bring with it extreme stresses in the materials, most likely beyond their ability to survive.

Various embodiments of the present disclosure thus contemplate a transom including a plate assembly that has a certain amount of give or bending in certain directions such as the vertical direction.

In one such example embodiment, the plate assembly is constructed of two thicknesses of grade 100, high-strength steel, each about 0.125 inches thick, to facilitate bending (somewhat like a leaf spring). This bending is produced by this swinging. The present disclosure thus contemplates that by employing two half-thicknesses for the plates, all else being equal, there is lower stress in the steel for a given applied bending displacement.

The present disclosure further contemplates that the two half-thickness plates suitably carry linear stress (i.e., tension-compression produced between the two side frames, or a combination of those as seen in warping) just as well as a single plate of equivalent thickness.

The present disclosure also contemplates a transom including several separate but attached plates in each connector assembly to provide certain limited amounts of flexibility.

Figure 10:
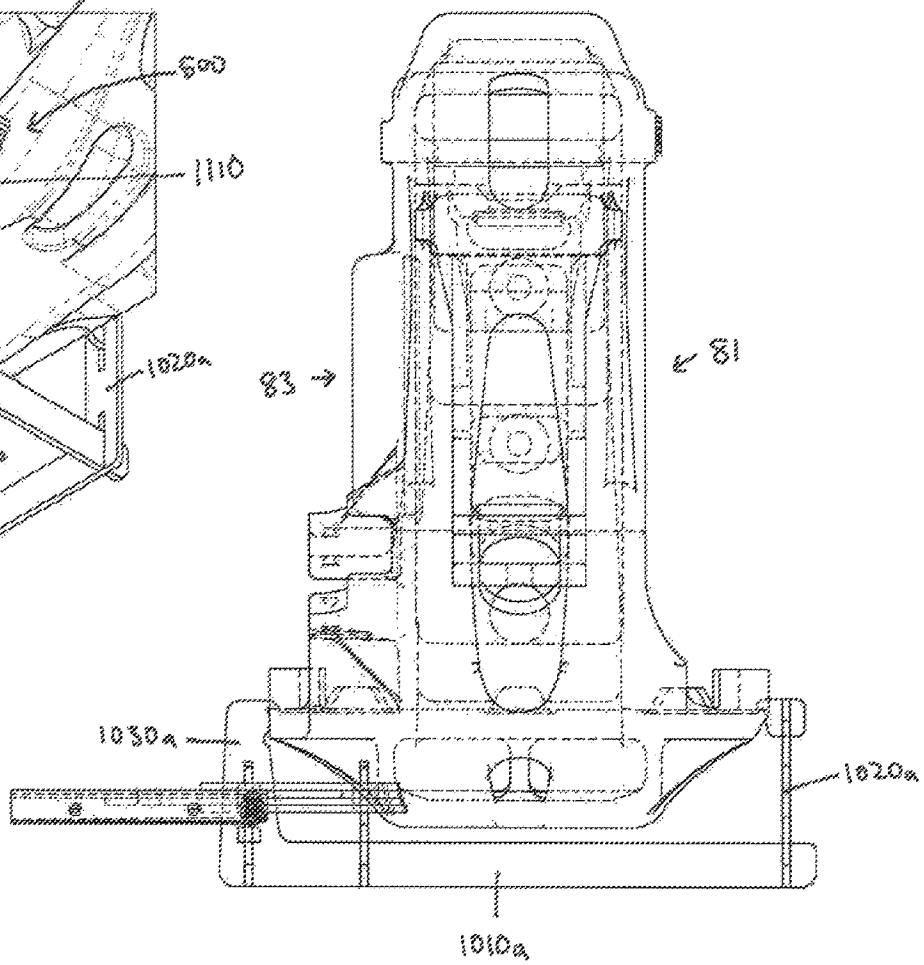
FIG. 10 is an enlarged end view of part of the railroad car truck of FIG. 3, showing part of the example transom of FIG. 3 connected to one of the side frames of the railroad car truck, and showing the example jig of FIG. 9.
Figure 9:
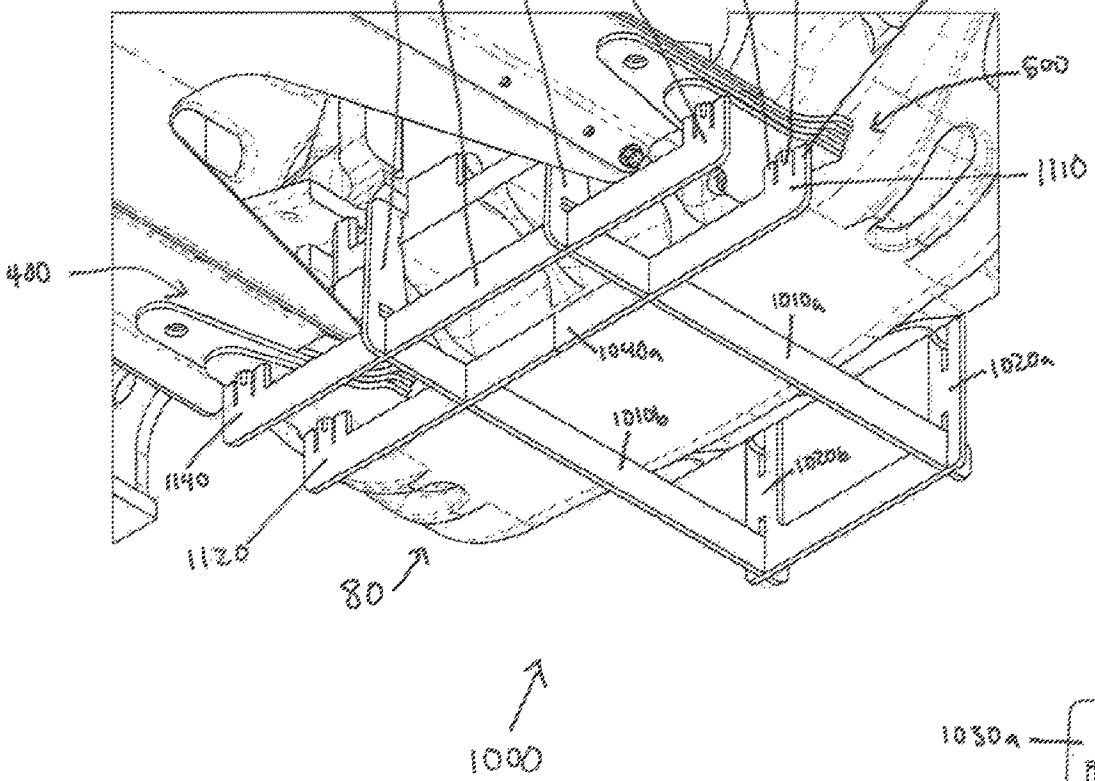
FIG. 9 is an enlarged fragmentary bottom perspective view of part of the railroad car truck of FIG. 3, showing part of the example transom of FIG. 3 connected to one of the side frames of the railroad car truck, and showing an example jig of the present disclosure used to support the transom for connection to the side frame.

As mentioned above, in various embodiments of the present disclosure, one or more attachment jigs are used to align the connector assemblies 200, 300, 400, and 500, as well as the panel assembly 110 with the side frames 60 and 80 during the manufacturing process (and specifically for aligning an positioning the connector assemblies relative to the side frames and during the welding process). FIGS. 9 and 10 illustrate an example first attachment jig 1000 configured to align connector assembly 400, connector assembly 500, and a first side of the panel assembly 110 with the second side frame 80. Additional same attachment jigs (not shown) can be simultaneously used to align the first connector assembly 200, the second connector assembly 300, and the second side of the panel assembly 110 with the first side frame 60.

In this illustrated example embodiment, the attachment jig 1000 includes: (1) a first horizontal base member 1010*a*; (2) a second horizontal base member 1010*b*; (3) vertical outside side frame engagement members 1020*a* and 1020*b*; (4) vertical inside side frame engagement members 1030*a* and 1030*b*; and (5) first and second lateral alignment members 1040*a* and 1040*b*.

The horizontal base members 1010*a* and 1010*b* extend under the side frame 80 from beyond an outside face 81 to beyond an inside face 83 of the side frame 80.

The vertical outside frame engagement members 1020*a* and 1020*b* are connected respectively via a first end to the horizontal base members 1010*a* and 1010*b*. The vertical outside members 1020*a* and 1020*b* extend upward vertically from the horizontal members 1010*a* and 1010*b*. A respective second end of the vertical outside members 1020*a* and 1020*b* is coupled to an outer surface of the side frame 80.

The vertical inside frame engagement members 1030*a* and 1030*b* are connected respectively via a first end to the horizontal base members 1010*a* and 1010*b*. The vertical inside members 1030*a* and 1030*b* extend upward vertically from the horizontal members 1010*a* and 1010*b*. A respective second end of the vertical inside members 1030*a* and 1030*b* is coupled to an inside surface of the side frame 80.

The lateral alignment members 1040*a* and 1040*b* extend laterally across both of the horizontal members 1010*a* and 1010*b*. Each lateral alignment member 1040*a* and 1040*b* includes a first end and a second end (1110, 1120, 1130, and 1140 respectively). In some embodiments, the first and second end of each lateral member is identical. As such, only one lateral member end will be described in detail.

Lateral member end 1110 includes three protruding alignment fingers 1111, 1112, and 1113. The center protruding alignment finger 1112 is configured to extend upward through the corresponding apertures of the connector assembly 500 and panel assembly 110 (where applicable). In particular, the center protruding alignment finger 1112 is configured to extend upward through apertures 513, 533, 553, and 573 of the fourth connector assembly 500. A center protruding alignment finger of end 1130 (not labeled) is configured to extend upward through apertures 514, 554, and 574 of the fourth connector assembly 500, as well as apertures 141 and 171 of panel assembly 110. The center protruding alignment fingers ensure proper horizontal alignment of the panel assembly 110 and the connector assembly 500.

The first side protruding alignment finger 1111 and the second side protruding alignment finger 1113 extend upward a shorter distance than the center protruding alignment finger 1112. The distance upward that each of the first and second side protruding alignment fingers 1111 and 1113 extend is such that the bottom support plate 570 of connector assembly 500 rests in proper vertical alignment with the side frame 80. The top connection plate 510, spacer plate 530, and bottom connection plate 550 then rest on the bottom support plate 570 in proper vertical alignment with each other and with the side frame 80.

The attachment jig 1000 is used in certain embodiments to align and assist with attachment of the connector assemblies 200, 300, 400, and 500 alone (i.e., without also connecting the panel assembly 110). In these embodiments, the connector assemblies 200, 300, 400, and 500 are aligned with the use of the jig 1000, and attached via welding to the side frames. The jig is then removed, so that the panel assembly can be attached to the connector assemblies.

Other example embodiments include using the attachment jig 1000 to assist with attachment of both the connector assemblies 200, 300, 400, and 500 as well as the panel assembly 110. In these embodiments, the connector assemblies and the panel assembly are aligned with the use of the jig 1000, and the connector assemblies are attached via welding to the side frames. The jig 1000 is then removed, so that the panel assembly can be attached to the connector assemblies using appropriate fasteners.

ADDITIONAL EMBODIMENTS

It should be appreciated that in various embodiments and in various circumstances, the transom 100 of the present disclosure may also act to provide other biasing forces to the side frames and/or may co-act with one or more other components of the railroad car truck to provide other biasing forces to the side frames. These other biasing effects of the transom of the present disclosure can be considered as secondary potential biasing effects.

It should further be appreciated that the transom of the present disclosure requires adding relatively little additional material or weight to the truck.

It should be appreciated that in various embodiments, the transom does not need any lubrication.

It should be appreciated that the transom of the present disclosure can be utilized to stabilize other vehicles or other vehicle trucks besides railroad cars or railroad car trucks.

Likewise, it should be appreciated that the jig of the present disclosure can be utilized to attach a transom to other vehicles or vehicle trucks besides railroad cars or railroad car trucks.

It will be understood that modifications and variations may be effected without departing from the scope of the novel concepts of the present invention, and it is understood that this application is to be limited only by the scope of the claims.

The invention claimed is:

1. A railroad car truck comprising:
a first side frame;
a second side frame;
a bolster; and
a transom including:
a panel assembly; and
a first connector assembly connecting the panel assembly to the first side frame,
a second connector assembly connecting the panel assembly to the first side frame,
a third connector assembly connecting the panel assembly to the second side frame,
a fourth connector assembly connecting the panel assembly to the second side frame,
wherein each connector assembly includes:
a top connection plate,
a spacer connection plate, and
at least one bottom connection plate.

2. The railroad car truck of claim 1, wherein the connection plates of each of the connector assemblies are made from steel.

3. The railroad car truck of claim 2, wherein the connection plates of each of the first and second connector assemblies are welded to the first side frame and the connection plates of each of the third and fourth connector assemblies are welded to the second side frame.

4. The railroad car truck of claim 1, wherein each connector assembly includes a first bottom connection plate and a second bottom support plate.

5. The railroad car truck of claim 4, wherein for each connector assembly, the top connection plate, the spacer connection plate, the first bottom connection plate, and the second bottom support plate have decreasing widths along their respective connection edges.

6. The railroad car truck of claim 4, wherein for each connector assembly, the top connection plate, the spacer connection plate, the first bottom connection plate, and the second bottom support plate are vertically aligned.

7. The railroad car truck of claim 1, wherein for each connector assembly, the top connection plate, the spacer connection plate, and the at least one bottom connection plate are positioned to form a space between the top connection plate and the at least one bottom connection plate.

8. The railroad car truck of claim 1, wherein the panel assembly includes a first transom plate, a second transom plate, and a third transom plate.

9. The railroad car truck of claim 8, wherein the first transom plate is connected to each of the first, second, third, and fourth connector assemblies by a plurality of fasteners.

10. The railroad car truck of claim 8, wherein the first transom plate defines tapered cutouts extending from opposite ends of the first transom plate.

11. The railroad car truck of claim 8, wherein the second transom plate is connected to the first side frame by the first connector assembly and is connected to the second side frame by the third connector assembly.

12. The railroad car truck of claim 11, wherein the third transom plate is connected to the first side frame by the second connector assembly and is connected to the second side frame by the fourth connector assembly.

13. The railroad car truck of claim 1, wherein the transom is configured to twist about an axis extending from the first side frame to the second side frame.

14. The railroad car truck of claim 1, wherein the transom is configured to enable lateral swing of the first and second side frames together.

15. The railroad car truck of claim 1, wherein the transom is configured to enable bending along an axis from the first side frame to second side frame.

16. A transom comprising:
a panel assembly;
a first connector assembly connectable to the panel assembly and a first side frame;
a second connector assembly connectable to the panel assembly and the first side frame;
a third connector assembly connectable to the panel assembly and to a second side frame; and
a fourth connector assembly connectable to the panel assembly and to the second side frame,
wherein each connector assembly includes:
a top connection plate,
a spacer connection plate, and
at least one bottom connection plate.

17. The transom of claim 16, wherein the connection plates of each of the connector assemblies are made from steel.

18. The transom of claim 17, wherein the connection plates of each of the first and second connector assemblies are weldable to the first side frame and the connection plates of each of the third and fourth connector assemblies are weldable to the second side frame.

19. The transom of claim 16, wherein each connector assembly includes a first bottom connection plate and a second bottom support plate.

20. The transom of claim 19, wherein for each connector assembly, the top connection plate, the spacer connection plate, the first bottom connection plate, and the second bottom support plate have decreasing widths along their respective connection edges.

21. The transom of claim 20, wherein for each connector assembly, the top connection plate, the spacer connection plate, the first bottom connection plate, and the second bottom support plate are vertically aligned.

22. The transom of claim 16, wherein for each connector assembly, the top connection plate, the spacer connection plate, and the at least one bottom connection plate are positioned to form a space between the top connection plate and the at least one bottom connection plate.

23. The transom of claim 16, wherein the panel assembly includes a first transom plate, a second transom plate, and a third transom plate.

24. The transom of claim 23 wherein the first transom plate is connected to each of the first, second, third, and fourth connector assemblies by a plurality of fasteners.

25. The transom of claim 23, wherein the first transom plate defines tapered cutouts extending from opposite ends of the first transom plate.

* * * * *